US011686176B2

(12) United States Patent
Provost

(10) Patent No.: US 11,686,176 B2
(45) Date of Patent: Jun. 27, 2023

(54) CIRCULATION SLEEVE AND METHOD

(71) Applicant: Wilfred Provost, Tomball, TX (US)

(72) Inventor: Wilfred Provost, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/178,745

(22) Filed: Feb. 18, 2021

(65) Prior Publication Data

US 2022/0259942 A1 Aug. 18, 2022

(51) Int. Cl.
*E21B 34/14* (2006.01)
*E21B 43/26* (2006.01)

(52) U.S. Cl.
CPC ..... *E21B 34/14* (2013.01); *E21B 43/26* (2013.01); *E21B 2200/01* (2020.05); *E21B 2200/06* (2020.05)

(58) Field of Classification Search
CPC ..... E21B 34/14; E21B 43/26; E21B 2200/01; E21B 2200/06; E21B 34/10
See application file for complete search history.

(56) References Cited

U.S. PATENT DOCUMENTS

| | | | | |
|---|---|---|---|---|
| 4,258,793 | A | 3/1981 | Mcgraw et al. | |
| 4,330,039 | A * | 5/1982 | Vann | E21B 34/103 166/299 |
| 5,819,853 | A * | 10/1998 | Patel | E21B 34/063 166/373 |
| 8,215,386 | B2 | 7/2012 | Manke et al. | |
| 8,555,960 | B2 * | 10/2013 | Mailand | E21B 34/10 166/334.4 |
| 8,944,167 | B2 * | 2/2015 | Ravensbergen | E21B 43/26 166/308.1 |
| 9,097,079 | B2 * | 8/2015 | Themig | E21B 23/02 |
| 9,115,565 | B1 | 8/2015 | Richards et al. | |
| 9,464,506 | B2 | 10/2016 | Coon et al. | |
| 10,030,513 | B2 | 7/2018 | Patel | |
| 10,392,910 | B2 | 8/2019 | Walton et al. | |
| 2010/0263873 | A1 * | 10/2010 | Turner | E21B 34/08 166/308.1 |

(Continued)

FOREIGN PATENT DOCUMENTS

WO 2012100012 A2 7/2012

OTHER PUBLICATIONS

One-Trip Multizone Sand-Control-Completion System in the Gulf of Mexico Lower Tertiary; https://pubs.spe.org/en/print-article/?art=3412; Oct. 2, 2017; 4 pages.

(Continued)

*Primary Examiner* — Daniel P Stephenson
(74) *Attorney, Agent, or Firm* — Cantor Colburn LLP

(57) ABSTRACT

A circulation sleeve including a housing, a mandrel disposed at least partially within the housing, the mandrel and the housing together configured to respond to pressure applied to the sleeve from radially outward of the housing by moving the housing to a position relative to the mandrel where a treatment port through a radial wall of the mandrel is exposed outside of the housing and to respond to fluid flow rate within the mandrel to move the housing to a position relative to the mandrel where the treatment port is disposed within the housing.

15 Claims, 4 Drawing Sheets

(56) References Cited

U.S. PATENT DOCUMENTS

| | | | | |
|---|---|---|---|---|
| 2011/0278016 | A1 | 11/2011 | Xu | |
| 2012/0273055 | A1 | 11/2012 | Lirette et al. | |
| 2014/0083714 | A1 | 3/2014 | Grigsby | |
| 2016/0251939 | A1 * | 9/2016 | Johnson | E21B 17/1078 166/305.1 |

OTHER PUBLICATIONS

Sliding Sleeves: Enable of shut off coommunication between the tubing and annulus; https://www.slb.com/completions/well-completions/completion-accessories/sliding-sleeves#related-information; Retrieved on Sep. 11, 2020; 4 pages.

Notification of Transmittal of the International Search Report and the Written Opinion of the International Searching Authority, or the Declaration; PCT/US2022/016555; dated May 24, 2022; 10 pages.

* cited by examiner

CIRCULATION SLEEVE AND METHOD

BACKGROUND

In the resource recovery industry long boreholes require many tools to prepare for productions and those tools require different actions to actuate them. While it is possible to run and install each tool individually, the process would be excruciatingly slow and costly. Not surprisingly, the art prefers tools that can be run together and actuated and also desires tools capable of enabling more than one actuation. Circulation tools sometime offer value in being able to operate in a first position, and then being able to operate in a second position to effect more than one actuation of other tools but these are still limited and cannot account for contingency operations. Consequently, while they improve efficiency they fall short of the desired efficiency and versatility more useful to the art. Accordingly, the art will well appreciate alternative tools that improve efficiency.

SUMMARY

An embodiment of a circulation sleeve including a housing, a mandrel disposed at least partially within the housing, the mandrel and the housing together configured to respond to pressure applied to the sleeve from radially outward of the housing by moving the housing to a position relative to the mandrel where a treatment port through a radial wall of the mandrel is exposed outside of the housing and to respond to fluid flow rate within the mandrel to move the housing to a position relative to the mandrel where the treatment port is disposed within the housing.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
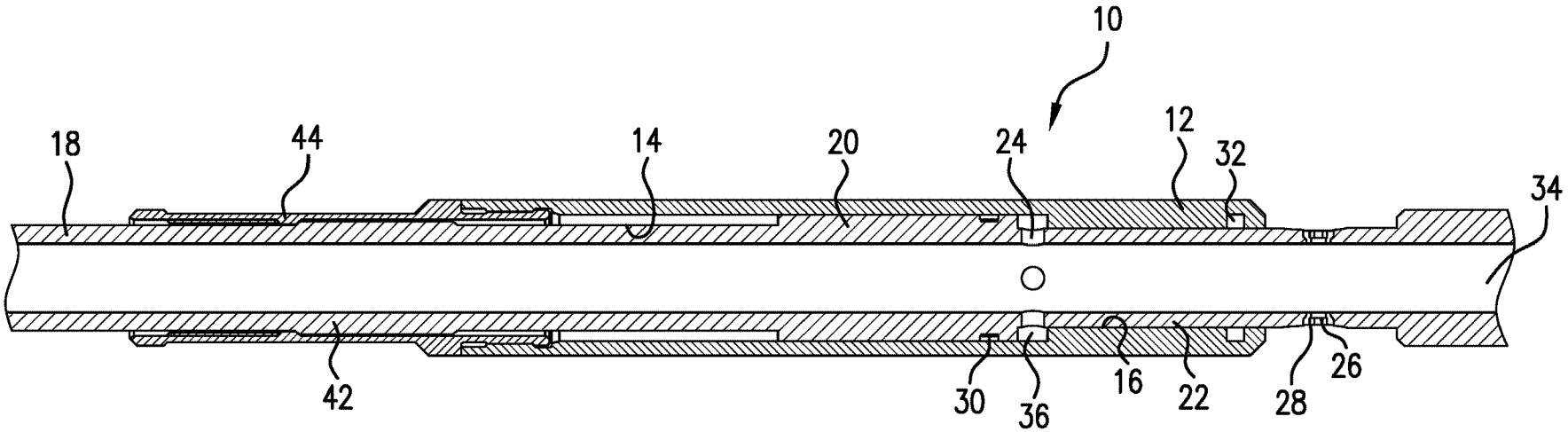
FIG. 1 is a view of a circulation sleeve disclosed herein in an open position.

Referring to FIG. 1, an embodiment of a circulation sleeve 10 disclosed herein is illustrated in an open position. The sleeve 10 includes a housing 12 having a major bore 14 and a minor bore 16, and a mandrel 18 upon which the housing 12 is slidably disposed. The mandrel includes an enlarged diameter portion 20 and a nonenlarged diameter portion 22. The enlarged diameter portion 20 is disposed within the major bore 14 while the nonenlarged diameter portion 22 is disposed in the minor bore 16. The mandrel 18 further includes an actuation port 24 and a treatment port 26. In an embodiment the treatment port may optionally also include a check valve 28.

Figure 2:
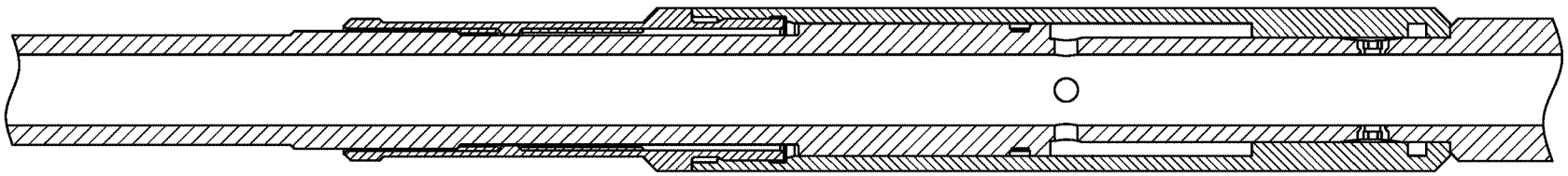
FIG. 2 is a view of the circulation sleeve of FIG. 1 in a closed position.

The sleeve 10 also includes seals 30 and 32. Upon consideration of FIG. 1, it will be readily apparent that the seal diameters among seals 30 and 32 are quite different. This difference provides utility in that a piston responsive to applied pressure from radially outward of the sleeve 10, i.e. from the annulus of the well as illustrated in FIG. 1 (for example about 800 PSI). In the open position circulation activities are enabled. On the other hand the actuation port 24 is part of a closure subsystem that closes the sleeve 10 pursuant to a threshold flow rate of fluid within the ID 34 (for example about 3 barrel per minute). The fluid flow in the ID 34 causes pressure within chamber 36 to increase and force the housing 12 to slide rightwardly in the illustration (See FIG. 2 positioning relative to FIG. 1) to move treatment port 26 past seal 32 and into housing 12. In this condition, the sleeve 10 is not subject to any movement from ID pressure events. Because of this condition, multiple pressure events can be used to actuate other tools without affecting the sleeve 10. Further, because the sleeve 10 may be cycled between open and closed repeatedly, and with ease simply by pressuring up on the annulus to open or flowing fluid in the ID above the threshold rate in the ID to close, many operations can be undertaken simply and reliably with sleeve 10. The configuration also presents many opportunities with regard to contingency plans since it can be opened and closed at will using annulus pressure and ID flow to do so as described.

Figure 3:
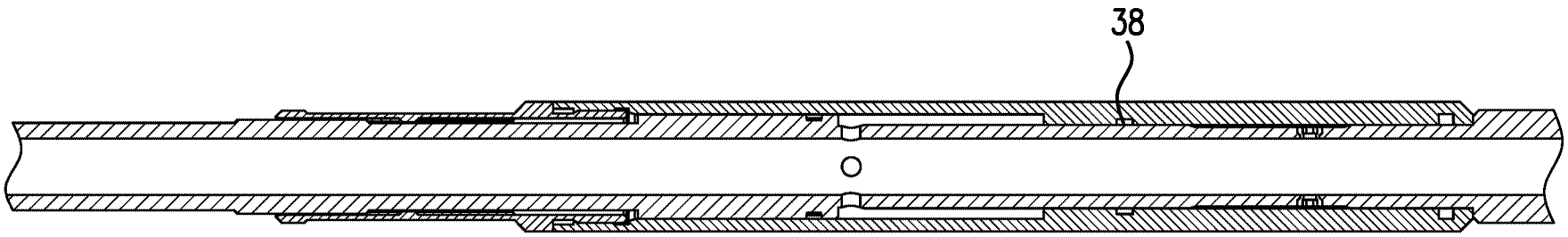
FIG. 3 is an alternate embodiment of the circulation sleeve disclosed herein.

Referring to FIG. 3, an optional embodiment includes a third seal 38 to improve longevity and reliability since this seal is not subject to the treatment port 26 moving thereunder. In other senses the embodiment of FIG. 3 is the same as those of FIGS. 1 and 2.

Also optional is a check valve 28 that may be disposed in the treatment port 26 in either the embodiment of FIG. 1 or the embodiment of FIG. 3. Where more than one treatment port 26 is included they may not all include a check valve 28. The check valve 28 can enhance performance of the sleeve 10 by restricting radially outwardly moving flow out of the mandrel 18 while facilitating circulation radially inwardly through the check valves into the mandrel 18.

With the specific structure of the disclosed sleeve 10 one can achieve multiple circulation events, at different physical positions within a wellbore system, having a multiplicity of steps of operation, and with multiple pressure activation events. This is not possible with art recognized circulation sleeves. This enables one-trip operations not available in the prior art.

Figure 4:
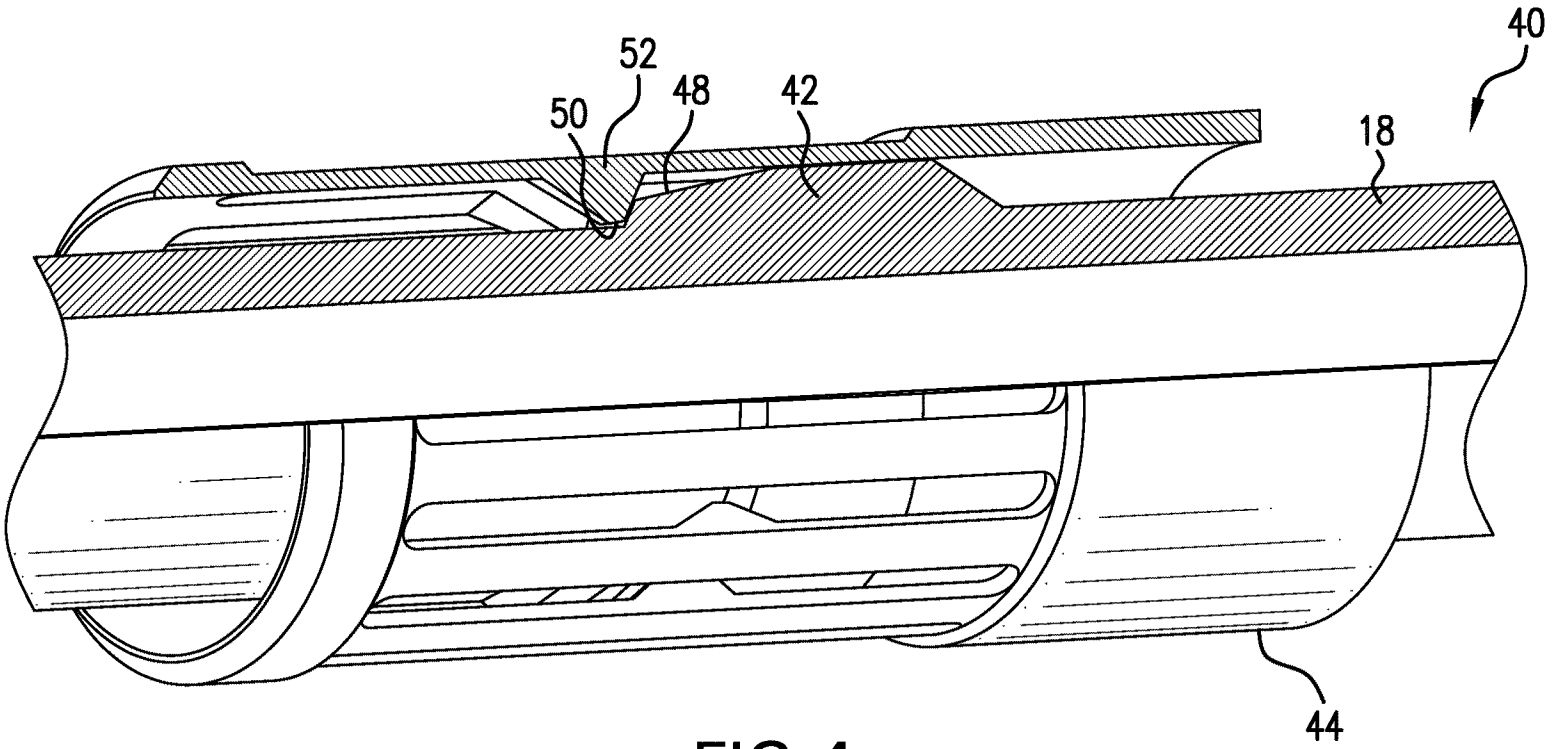
FIG. 4 is an enlarged perspective view of a mandrel profile and a collet of the circulation sleeve disclosed herein.
Figure 5:
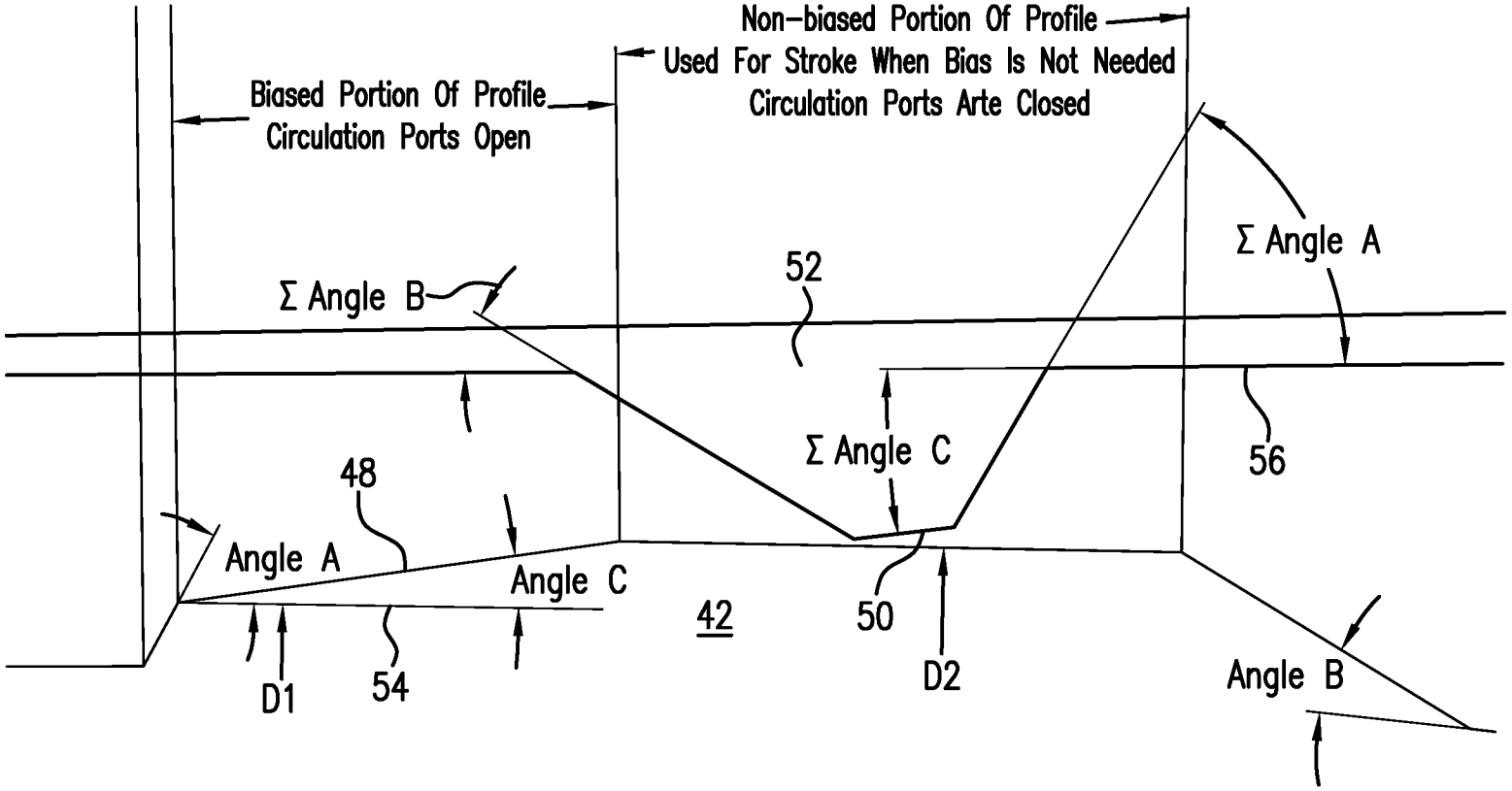
FIG. 5 is a line drawing of a cross section of the profile and collet finger illustrating angles of faces.

Referring to FIG. 4, an enlarged perspective view of a portion of the sleeve 10 is illustrated. It is important to note that the axial assistance system 40 is optional and need not be included. In some cases, however, it might be desirable to add the axial assistance system 40. The system 40 includes an upset profile 42 on the mandrel 18 and a collet 44 slidably positioned adjacent the profile 42. The collet is attached to the housing 12. Referring to FIG. 5, a cross section view of the profile 42 and a collet finger 52 are illustrated without the perspective view of FIG. 4 to make evident some of the angles presented. Specifically, angle C is important to functionality and a length of surface 48 is important to functionality. The angle C is found on both the surface 48 of the profile 42 and also on a surface 50 of a collet finger 52 and is in a range of about 5 to about 30 degrees from a reference horizontal line 54 across the Figure and from a surface 56 of collet finger 52, respectively. The angle C is the same in both instances. Configuring surfaces 48 and 50 at the same angle facilitates sliding of the collet 44 on the surface 48 and thereby facilitates the conversion of radially inwardly directed force from the collet 44 to axially directed movement of the mandrel 18 relative to the collet 44 and housing 12. This axial movement is useful in completing movements of the collet that are related to pressure differential when the pressure differential becomes difficult to maintain pursuant to a port opening and allowing at least some of that pressure differential to leak off. The length of surface 48 provides the length of axial assistance and the angle presented by surface 48 dictates the resultant axial force applied, with greater angles providing greater force albeit for shorter axial distances. Other angles noted include A and B, which are at about 30 to about 60 degrees and about 25 to about 40, respectively, from respective reference planes shown in FIG. 5. In each case it is desirable that angle A is greater than angle B and angle A is greater than angle C.

Mathematically, the relationships of the various identified variables in FIG. 5 are as follows:

D1 is the diameter of profile 42.

δ1 is the deflection required to get the collet 44 to D1, to pass over profile 42.

Angle A is one of the angles of profile 42 as identified in FIG. 5.

R1 is the radial force required to generate this deflection.

$$R1=f(\delta 1)$$

The function f varies with the specific geometry of the axial assistance system 40. For collets, such as collet 44, this is a beam bending equation.

F1 is the axial force required to push the collet over this portion (the portion with angle A) of the profile 42.

$$F1=R1*\sin(A)$$

D2 is the diameter of profile 42 dictated by the angle B.

δ2 is the deflection required to get the collet 44 to D2, to pass over this portion of the profile 42 dictated by angle B in FIG. 5.

R2 is the radial force required to generate this deflection.

$$R2=f(\delta 2)$$

F2 is the axial force required to push the collet 44 over this portion of profile 42.

$$F2=R2*\sin(B)$$

A, B, δ1 and δ2, can be selected such that F1=F2.

$$f(\delta 2)*\sin(B)=f(\delta 1)*\sin(A)$$

F1 and F2 can be configured to whatever is desired for the function of the device, within the constraints of the geometry. F1<F2 or F1>F2 are possible by varying the angles. For the circulation sleeve 10, in an embodiment F1 and F2 are about equal since that will appropriately support the function of the device as disclosed.

Returning to Angle C and surface 48, the portion of the profile 42 that generates axial force over a significant distance, F3 is the axial force required to push the collet 44 over this surface 48. Since the surface 48 ends at D2, $$F3=R3*\sin(C)$$

In embodiments, $$90°>A>B>C>0°$$

So $$F1>F2>F3$$

Therefore, when applying F1 to pass the collet tab over angle A, the collet tab will always continue to pass over angle C with no additional force input. The exact value of F3 is irrelevant to the function of the device under these conditions.

F3 is important when the collet is being shifted over the portion of profile 42 dictated by Angle B, and Angle C is actually being used to help shift the collet 44 to its final position.

The axial force generated onto the collet 44 by surface 48 at Angle C varies.

For Angle C and surface 48, it may be desirable to calculate axial force creation at varying position of the collet and surface 50 relative to surface 48. Equation F=f(δ)*sin(C) provides this information where δ varies anywhere from δ2 to δ3 depending on the position of the collet finger 52 relative to the surface 48.

Therefore, the minimum axial force supplied by angle C and surface 48 is as follows:

$$Fcmin=f(\delta 1)*\sin(C)$$

This is to be compared to the friction of the sleeve 10, and any residual actuation forces acting thereon, to determine if sleeve 10 will continue to its final position or not.

If Fcmin−Friction+Actuation Force>0, then the valve will successfully finish shifting.

The axial assistance system 40 is practical for sleeve 10 because the only additional axial motive force that might be desired is to overcome the friction of non-energized seals.

Alternatively, the axial assistance system 40 may be configured as a simple bidirectional collet and profile known to the art that has for its function to set the threshold fluid flow required to close the sleeve 10 and the threshold annular pressure to open the sleeve 10. Specifically, the collet would need to be sufficiently pushed by the differential pressure or the threshold fluid flow rate to pop over the profile in the direction related to the action being taken. This occurs as a part of the axial assistance system but as noted the axial assistance system is optional to help close the sleeve 10 but a prior art collet would be employed if the additional axial motive force is not desired.

The sleeve 10 as described enables one trip operations that include such steps as:

Run in Hole with the sleeve open to allow well fluid to fill the system; Close the sleeve, circulate out the shoe to get into the open hole section; Open the sleeve to circulate fluid for well control while in the open hole section; Close the sleeve to circulate breaker fluid out the shoe; Close the sleeve, set a Lower Completion packer; Open the sleeve, circulate fluid above the Lower completion packer; Close the sleeve, apply differential pressure to set the Upper completion packer, and more. Those of skill in the art will appreciate the versatility of the circulation sleeve 10.

Figure 6:
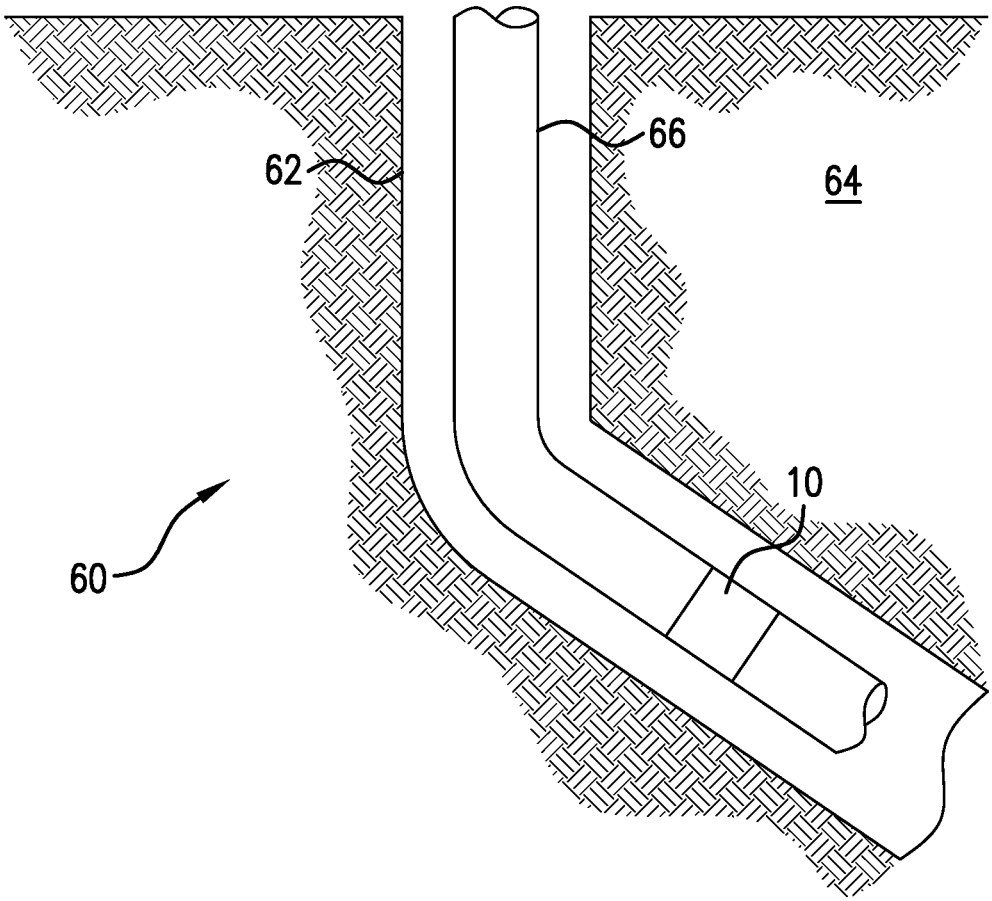
FIG. 6 is a schematic view of a wellbore system including the circulation sleeve as disclosed herein.

Referring to FIG. 6, a schematic view of a wellbore system 60 is illustrated with the circulation sleeve 10 disposed therein. The system 60 includes a borehole 62 in a formation 64. A string 66 is disposed in the borehole 62 and the circulation sleeve 10 is a part of the string 66.

Set forth below are some embodiments of the foregoing disclosure:

Embodiment 1: A circulation sleeve including a housing, a mandrel disposed at least partially within the housing, the mandrel and the housing together configured to respond to pressure applied to the sleeve from radially outward of the housing by moving the housing to a position relative to the mandrel where a treatment port through a radial wall of the mandrel is exposed outside of the housing and to respond to fluid flow rate within the mandrel to move the housing to a position relative to the mandrel where the treatment port is disposed within the housing.

Embodiment 2: The circulation sleeve as in any prior embodiment, wherein the housing defines a major bore in a portions thereof and a minor bore in a portion thereof.

Embodiment 3: The circulation sleeve as in any prior embodiment, wherein the mandrel includes an actuation port, and an enlarged diameter portion.

Embodiment 4: The circulation sleeve as in any prior embodiment, wherein the enlarged diameter portion is disposed in sliding relationship with the major bore of the housing.

Embodiment 5: The circulation sleeve as in any prior embodiment, wherein a seal is disposed between the mandrel enlarged diameter portion and the housing major bore.

Embodiment 6: The circulation sleeve as in any prior embodiment, wherein the mandrel further defines a nonenlarged diameter portion disposed in sliding relationship with the minor bore.

Embodiment 7: The circulation sleeve as in any prior embodiment, wherein another seal is disposed between the nonenlarged diameter portion of the mandrel and the minor bore of the housing.

Embodiment 8: The circulation sleeve as in any prior embodiment, wherein the seal and the another seal are of different diameters.

Embodiment 9: The circulation sleeve as in any prior embodiment, wherein the actuation port extends through a radial wall of the mandrel fluidly joining an inside diameter of the mandrel and the major bore of the housing.

Embodiment 10: The circulation sleeve as in any prior embodiment, wherein the treatment port includes a check valve.

Embodiment 11: The circulation sleeve as in any prior embodiment, wherein a third seal is disposed between the nonenlarged diameter portion of the mandrel and the minor bore of the housing.

Embodiment 12: The circulation sleeve as in any prior embodiment further comprising a collet and profile attached to the housing and mandrel, respectively, to restrict movement of the sleeve until a threshold fluid flow required to close the sleeve or a threshold annular pressure required to open the sleeve is experienced.

Embodiment 13: The circulation sleeve as in any prior embodiment further comprising an axial assistance system.

Embodiment 14: The circulation sleeve as in any prior embodiment, wherein the axial assistance system comprises an upset profile on the mandrel, the upset profile including an angled surface interactive with a collet connected to the housing to convert a radially inwardly directed force from the collet to an axial motion of the mandrel.

Embodiment 15: A method of performing circulating operations in a wellbore in one trip including running the circulating sleeve as in any prior embodiment to a target location in the wellbore, taking a wellbore action, changing a position of the sleeve, taking another wellbore action, and restoring an initial position of the circulating sleeve.

Embodiment 16: The method as in any prior embodiment, wherein the changing is by one or the other of pressuring on the sleeve from an annulus about the sleeve or flowing fluid at above a threshold rate through an inside diameter of the mandrel of the sleeve.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A circulation sleeve comprising:

a housing;

a mandrel disposed at least partially within the housing, the mandrel and the housing together configured to respond to pressure applied to the sleeve from radially outward of the housing by moving the housing to a position relative to the mandrel where a treatment port through a radial wall of the mandrel is fully exposed outside of the housing and to respond to fluid flow rate within the mandrel to move the housing to a position relative to the mandrel where the treatment port is fully disposed within the housing; and an axial assistance system that assists the movement of the mandrel relative to the housing between positions where the port is fully exposed and where the port is fully disposed within the housing.

2. The circulation sleeve as claimed in claim 1 wherein the housing; and an axial assistance system that assists the movement of the mandrel relative to the housing between positions where the port is fully exposed and where the port is fully disposed within the housing. defines a major bore in a portions thereof and a minor bore in a portion thereof.

3. The circulation sleeve as claimed in claim 2 wherein the mandrel includes an actuation port, and an enlarged diameter portion.

4. The circulation sleeve as claimed in claim 3 wherein the enlarged diameter portion is disposed in sliding relationship with the major bore of the housing.

5. The circulation sleeve as claimed in claim 4 wherein a seal is disposed between the mandrel enlarged diameter portion and the housing major bore.

6. The circulation sleeve as claimed in claim 5 wherein the mandrel further defines a nonenlarged diameter portion disposed in sliding relationship with the minor bore.

7. The circulation sleeve as claimed in claim 6 wherein another seal is disposed between the nonenlarged diameter portion of the mandrel and the minor bore of the housing.

8. The circulation sleeve as claimed in claim 7 wherein the seal and the another seal are of different diameters.

9. The circulation sleeve as claimed in claim 3 wherein the actuation port extends through a radial wall of the mandrel fluidly joining an inside diameter of the mandrel and the major bore of the housing.

10. The circulation sleeve as claimed in claim 1 wherein the treatment port includes a check valve.

11. The circulation sleeve as claimed in claim 6 wherein a third seal is disposed between the nonenlarged diameter portion of the mandrel and the minor bore of the housing.

12. The circulation sleeve as claimed in claim 1 further comprising a collet and profile attached to the housing and mandrel, respectively, to restrict movement of the sleeve until a threshold fluid flow required to close the sleeve or a threshold annular pressure required to open the sleeve is experienced.

13. The circulation sleeve as claimed in claim 1 wherein the axial assistance system comprises an upset profile on the mandrel, the upset profile including an angled surface interactive with a collet connected to the housing to convert a radially inwardly directed force from the collet to an axial motion of the mandrel.

14. A method of performing circulating operations in a wellbore in one trip comprising:

running the circulating sleeve as claimed in claim 1 to a target location in the wellbore;

taking a wellbore action;

changing a position of the sleeve;

taking another wellbore action; and restoring an initial position of the circulating sleeve.

15. The method as claimed in claim 14 wherein the changing is by one or the other of pressuring on the sleeve from an annulus about the sleeve or flowing fluid at above a threshold rate through an inside diameter of the mandrel of the sleeve.

* * * * *